United States Patent [19]

Feldmann et al.

[11] Patent Number: 5,020,208

[45] Date of Patent: Jun. 4, 1991

[54] PROCESS FOR HEATING A SEMIFINISHED PRODUCT PRODUCED BY CONTINUOUS CASTING OR DEFORMATION

[75] Inventors: Hugo Feldmann, Alsdorf; Claus Schlanzke, Ratingen; Ulrich Svejovsky, Wuppertal, all of Fed. Rep. of Germany

[73] Assignee: Sms Schloemann-Siemag Aktiengesellschaft, Dusseldorf, Fed. Rep. of Germany

[21] Appl. No.: 4,084

[22] Filed: Jan. 15, 1987

[30] Foreign Application Priority Data

Jan. 16, 1986 [DE] Fed. Rep. of Germany ..... 3601084
Jul. 3, 1986 [DE] Fed. Rep. of Germany ..... 3622302

[51] Int. Cl.[5] ..... B21B 1/46

[52] U.S. Cl. ..... 29/527.7; 29/527.5; 72/200; 198/952; 432/121; 432/128

[58] Field of Search ..... 29/527.5, 527.7; 432/121; 72/200; 198/952

[56] References Cited

U.S. PATENT DOCUMENTS

| | | | |
|---|---|---|---|
| 4,217,095 | 8/1980 | Tokitsu | 29/527.7 X |
| 4,229,878 | 10/1980 | Ushijima | 29/527.2 |
| 4,260,371 | 4/1981 | O'ffill | 432/121 X |
| 4,289,944 | 9/1981 | Reese | 198/952 X |
| 4,311,454 | 1/1982 | Tabuchi . | |
| 4,586,897 | 5/1986 | Weber et al. | 432/121 |
| 4,627,814 | 12/1986 | Hattori et al. | 432/128 |
| 4,629,417 | 12/1986 | Patalon | 432/128 X |

FOREIGN PATENT DOCUMENTS

| | | | |
|---|---|---|---|
| 1189575 | 3/1965 | Fed. Rep. of Germany . | |
| 1199301 | 8/1965 | Fed. Rep. of Germany . | |
| 1816868 | 7/1970 | Fed. Rep. of Germany . | |
| 2723626 | 11/1978 | Fed. Rep. of Germany . | |
| 3310867 | 10/1984 | Fed. Rep. of Germany . | |
| 3422922 | 6/1985 | Fed. Rep. of Germany . | |
| 57-061481 | 12/1982 | Japan | 72/200 |
| 57-202907 | 12/1982 | Japan . | |
| 58-20301 | 2/1983 | Japan . | |
| 58-154409 | 9/1983 | Japan | 72/200 |
| 58-204128 | 11/1983 | Japan . | |
| 58-221602 | 12/1983 | Japan | 72/200 |
| 59-304401 | 2/1984 | Japan | 72/200 |
| 59-190327 | 10/1984 | Japan . | |
| 60-96302 | 5/1985 | Japan | 72/200 |
| 60-255201 | 12/1985 | Japan . | |
| 2705 | 10/1982 | Luxembourg . | |

*Primary Examiner*—Carl J. Arbes
*Attorney, Agent, or Firm*—Herbert Dubno; Andrew Wilford

[57] ABSTRACT

The process of our invention heats a plurality of partially finished products extruded in an extrusion unit or changed in a transforming unit as a preparation for introduction into subsequent transformation or processing units. In extruding and/or transforming or heating the heat applied to at least one partially finished product length group is transferred during intermediate transport of the partially finished product length group and/or during storage by heat transfer with other partially finished product length groups. The heat transfer is caused by radiation, convention and/or direct contact. An apparatus for performing the process according to our invention comprising a thermal insulating chamber provided with an air flow and air feed devices and if necessary an auxiliary heating unit is also provided.

12 Claims, 4 Drawing Sheets

PROCESS FOR HEATING A SEMIFINISHED PRODUCT PRODUCED BY CONTINUOUS CASTING OR DEFORMATION

FIELD OF THE INVENTION

Our present invention relates to a process for or a method of heating a plurality of semifinished products which have been subjected to deformation, e.g. rough rolling, and/or produced by continuous casting, more particularly, the invention relates to a method of improving the utilization of the intrinsic or sensible heat resulting from continuous casting and in the preparation of slabs or other semifinished steel products for roughing deformation (e.g. rolling) and in the preparation of the preliminary deformation products for final rolling.

BACKGROUND OF THE INVENTION

A variety of operating processes and devices are known in which semifinished products, which are transported in the direction of their longitudinal axis or transverse to it, are guided to a storage area and, corresponding to the requirements of the subsequent processes, can be brought to a heated furnace in which they are heated to a subsequent process temperature and then are fed to the appropriate processing site.

The continuous casting heat of the semifinished product coming from an continuous casting device can be utilized in a further process. A path upstream of the subsequent process can be provided in such manner that the partially finished product is not cooled to the storage temperature but is fed to the heating oven of the rolling unit or heating device arranged upstream of the rolling unit.

When the semifinished product (e.g. slabs to be further rolled, or billets or blooms) of the continuous casting unit is taken away continuously at a fixed rate, the rate at which the rough-shaped articles are available may not be suited for the further processing speed and the further processing time of the finishing deformation operation and further processing stations and, buffer storage are usually associated with the heating furnace and can be provided between it and the continuous casting device, with which the different capacities based on the differences in the initial and subsequent processing speeds are matched (German Open Patent Application 27 23 626).

It is also known to use, in a sense, the continuous casting heat of the semifinished product by transferring such heat to the already cooled and even not semifinished product by providing them together in one and the same heating furnace. This shortens the heating time to a desired subsequent processing temperature or permits the heated semifinished product to remain in the furnace for a shorter time than the cold product.

This interdependence between the continuous casting device and the subsequent processing unit makes it difficult to adjust the components of the total unit, such as the deforming (e.g. primary rolling) device, after-heating unit, and buffer storage with respect to one another.

In practical operation, frequently cold products from storage areas are introduced to the heat-transferring furnace so that the semifinished product fed to the subsequent rolling unit cannot be removed from the furnace in requisite numbers.

The processing of semifinished products having a variety of dimensions requires an expensive program plan and control of the steel plant, the continuous casting device and the subsequent processing device. Even where computer control is available to establish such programs the entire unit is not very flexible when products of different dimensions should be produced in fewer or larger numbers of pieces. An additional disadvantage is that the individual components of the entire unit are not driven independently of each other but must be driven jointly so that in part increased empty run times are unavoidable. Also the storage requires an increased organizational expense.

Attempts, for example with high quality steel rolling with conventional rolling programs using known working processes, using the previously described approach with heat transfer between hot and cold semifinished products allows a more or less direct pass through of the semifinished product to make up only 20 to 30% of the total output of the finishing rolls.

Besides these difficulties and disadvantages which accompany the use of the known working processes, it is frequently necessary that the semifinished product be inspected and, if necessary, cleaned in the subsequent processing in a still heated state instead of in a cooled condition on its path or in the storage areas.

OBJECTS OF THE INVENTION

It is an object of our invention to provide an improved method for heating a semifinished product of a continuous casting process which avoids at least some of the drawbacks of earlier systems.

It is also an object of our invention to provide an improved process and apparatus for controlling the balance in a continuous casting process to effect energy and other economies.

It is a further object of our invention to provide an improved process and apparatus for heating a semifinished product in a continuous casting process in which the individual components of the continuous casting and subsequent processing portions of the total unit are easily and inexpensively adjusted to each other to provide for optimal operation.

SUMMARY OF THE INVENTION

These objects and others which will become more readily apparent hereinafter are attained in accordance with our invention in a process for heating a plurality of semifinished products produced in a continuous casting unit or subjected to a shape or dimension change in a deforming (e.g. primary rolling) unit as a preparation for their introduction into a subsequent deforming (e.g. finished rolling) or finishing units. A typical "finishing" unit, as this term is used here, is a line of rolling stands.

According to our invention the initially created heat by continuous casting and/or for deforming (e.g. preliminary rolling) or at least one group of semifinished articles (or lengths) is transferred, during intermediate transport of the groups of semifinished products and/or during storage by heat transfer, to other groups of semifinished products during the travel of at least one of the groups.

Advantageously the heat transfer is effected by radiation, convection and/or direct contact. The heat transfer from at least one of the groups of semifinished products to another group of semifinished products is effected during transport of at least one group, but preferably both of them. The arrangement can be so designed that the colder one of the groups of semifinished products is positioned above the warmer one.

When both semifinished product groups are moved during heat transfer, the heat transfer can be effected with the directions of the transport of the semifinished product groups opposite one another.

However it is also possible to effect the heat transfer with the direction of transport being the same for the two semifinished product groups.

In another embodiment of our invention the directions of transport of the two semifinished product groups run transversely to one another during heat transfer.

In a special case the heat transfer is effected by contacting the members of the two groups with each other.

Further according to our invention at least on of the semifinished product groups can be kept spaced from the other during heat transfer. The spacing between the two semifinished product groups exchanging heat can then be only a distance of several mm, e.g. about 3 mm.

Each of the semifinished products can be rotated around its longitudinal axis before, during and after the transport and/or the heat transfer.

The invention also provide that the heat transfer is effected with a plurality of different transport speeds for the semifinished product groups.

Also advantageously according to our invention the transport of the semifinished product groups can be effected in a plurality of transport motions provided adjacent each other and/or in a plurality of transport planes positioned one above the other. The transport of one of two semifinished product groups either from which heat is taken or to which heat is transferred runs on both sides of the transport of the other semifinished product group.

A nonmoving semifinished product group as provided by the invention can be provided at the array of intermediate storage locations positioned between the continuous casting unit and the deforming (e.g. primary rolling) unit and/or between the primary and finish rolling units.

Appropriately the heat transfer can be effected between the semifinished product groups at least in part in a thermally insulated chamber surrounding the heat transfer. In such a thermally insulated chamber the semifinished product groups from which heat is to be abstracted are introduced and are guided therein from the continuous casting unit and/or from at least one of the deforming (e.g. primary rolling) units or an intermediate storage area.

The thermally insulated chamber for heating a plurality of semifinished products extruded in a continuous casting unit or shaped in a deforming (e.g. primary rolling) unit for introduction into subsequent deformation or processing units has an air flow and an air conduction device positioned in it and, if necessary, heating units (e.g. burners).

The semifinished product groups during the heat transfer are positioned in two or more planes one above the other and in at least one of the planes can perform a rotational motion opposite the semifinished products in the adjacent ones of the planes. The semifinished product groups fed to the deforming (e.g. primary rolling) location can thus be heated by the primary rolled product in the deforming which is produced thereby.

The thermally insulating chamber can comprise a plurality of supporting bar grates positioned side by side or one above the other and/or a plurality of pushing, pulling, turning or supporting elements for the semifinished products which are drivable independently of each other or, in part jointly. Advantageously the spacing of a plurality of bar grate beams for the upper supporting bar grate is greater than the spacing of the bar grate beams of the lower supporting bar grate.

The process according to our invention decouples completely the flow of semifinished groups between the different continuous casting, deformation, heating, storage and other subsequent processing devices and controls and directs the flow corresponding to some of the requirements and conditions so that besides the continuation of the flow an optimal use of the introduced and/or freshly introduced process heat is effected in the deformation and/or heating process.

Thus for example the continuation of the introduction of semifinished product groups coming from the continuous casting direction is achieved during transport or during a stoppage of transport by heat transfer from these semifinished product groups to intermediately juxtaposed cooled or still residually heated other semifinished product groups, if necessary augmented with heat produced by use of a subsequent heating unit connected in front of or upstream of the deforming (e.g. preliminary rolling) unit. With appropriate arrangement and design of the unit it is possible to feed the semifinished product groups coming from the extruder without intermediate storage directly to the deforming (e.g. preliminary rolling) device at the desired process temperature.

In this heat transfer process of the invention semifinished product groups or also finished material movable between automatic deforming (e.g. rolling) units are able to collect heat from or to supply required heat, for example using transport paths according to our invention positioned transversely to each other or, if necessary, in planes one above the other.

Conversion of some processing programs with correct design of the process according to our invention effects just as little the material flow as the speed changes or changes in the further processing unit. Lot size can be selected and is independent of the size of the charge. The flexibility of the entire unit allows this with comparatively simple program planning.

Since the semifinished products, when desired, can be cooled slowly and likewise also heated slowly special advantages result when high quality steels are fabricated. The inspection and cleaning operations can be undertaken in the cooled semifinished products beyond the material flow. The operating process according to our invention allows a heat input in the form of the semifinished products considerably above the 30% up to no attainable.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

As seen from FIG. 1 the semifinished products coming in the direction St from the continuous casting machine are fed to the thermally insulated chamber $WK_1$ by a roller conveyor $R_1$ and are brought into contact or heat-transferring relation for heat transfer during movement with semifinished product groups coming from a storage unit $L_2$ via roller conveyor $R_3$ and subsequently fed by a roller conveyor $R_2$ to the storage unit $L_1$ after heat transfer in this step.

The stock in such groups can be fed to an after-heating device $NW_1$ (from the storage unit $L_2$) by a roller conveyor $R_4$, and are there brought to the desired process temperature and fed to a primary rolling-mill line HT.

The semifinished products from the rolling line HT arrive at the thermally insulated chamber $WK_2$ by a roller conveyor $R_5$ or can be fed through the chamber $WK_2$ to the thermally insulated chamber $WK_3$ by a roller conveyor $R_9$.

The semifinished product groups arriving in the thermally insulated chamber $WK_2$ are brought into contact or close heat-transferring relation for transfer of heat with semifinished product groups from storage unit $L_4$ delivered by a roller conveyor R8 and can subsequently be fed to a storage unit $L_3$ by a roller conveyor $R_7$ while the semifinished product groups coming from storage area $L_4$ heated by this process are fed by the roller conveyor $R_6$ to an after-heating unit $NW_2$ upstream of a finishing roller unit $FW_1$ formed by another rolling-mill line.

In the thermally insulated chamber $WK_3$ the process runs as in the already described thermally insulating chambers $WK_1$ and $WK_2$ The semifinished product groups brought by the roller conveyor $R_9$ into the thermally insulating chamber $WK_3$, heat the semifinished product length group brought by the roller conveyor $R_{12}$ into the thermally insulating chamber $WK_3$ during relative movement in close proximity whereupon the heated products are subsequently fed by the roller conveyor $R_{11}$ to the after-heating unit $NW_3$ associated with the finishing roll unit $FW_2$.

Figure 2:
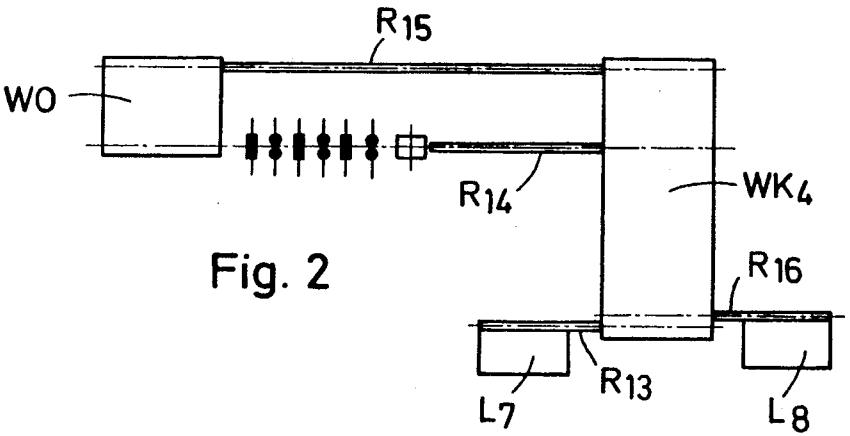
FIG. 2 is a top plan view of portion of a plant using principles of the process according to our invention.

FIG. 2 shows an arrangement in which the waste heat of the cooled semifinished product groups is used to preheat a semifinished product length group brought into the heating furnace. They are fed to a heat insulating chamber $WK_4$ by a roller conveyor $R_{14}$, brought by transverse transport in contact for heat transfer with semifinished product groups coming by a roller conveyor $R_{13}$ from storage area $L_7$ and subsequently fed by a roller conveyor $R_{16}$ to the storage area $L_8$ while the heated semifinished product groups coming from storage area $L_7$ are fed by a roller conveyor $R_{15}$ to a heating furnace WO.

Figure 3:
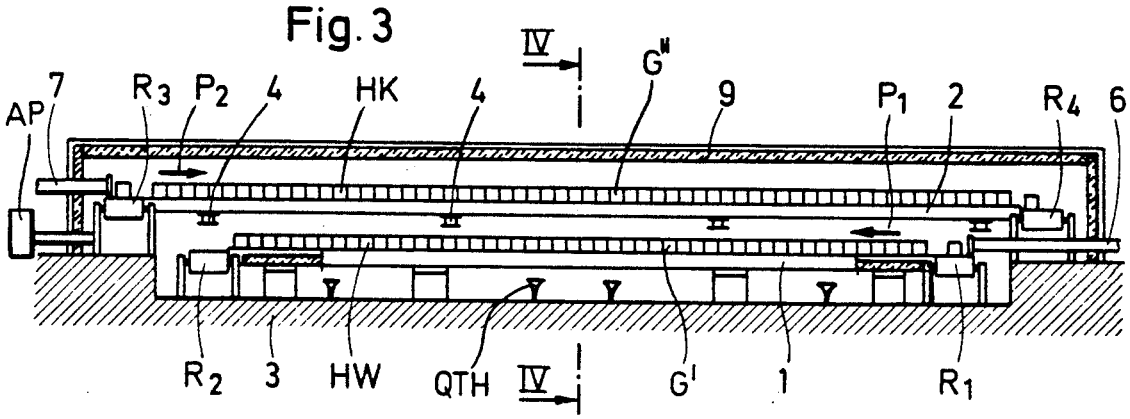
FIG. 3 is a side cross sectional view of a heating unit of a plant for performing the process according to our invention with supporting bar grates.
Figure 4:
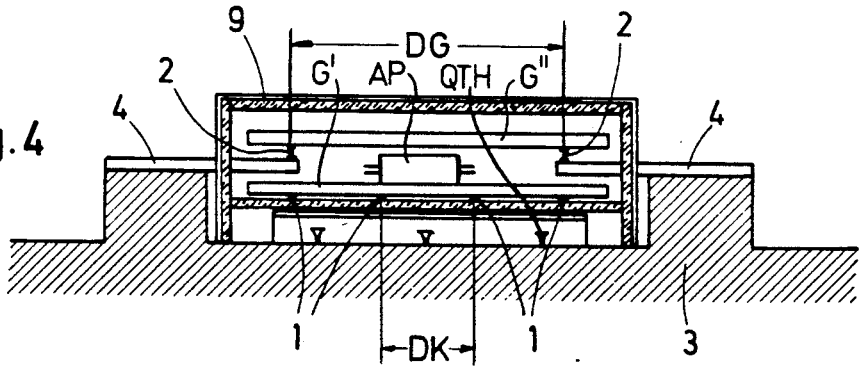
FIG. 4 is a cross sectional view of the heating unit of FIG. 3 taken along the line IV—IV thereof.

As shown in FIG. 3 two bar grates G" and G' of the pusher-type heat transfer unit are spaced from each other and receive the semifinished product groups HW and HK. The lower fixed supporting bar grate G' for the semifinished product length group HW coming from the continuous casting machine Ex/T has bar grate beams 1 which are positioned from each other with a spacing DK (FIG. 4) while the upper bar grate G" receiving the semifinished products coming from the storage area has a pair of bar grate beams 2 which are supported by the supporting beams 4 mounted on the foundation 3 with spacing DG (FIG. 4).

Figure 1:
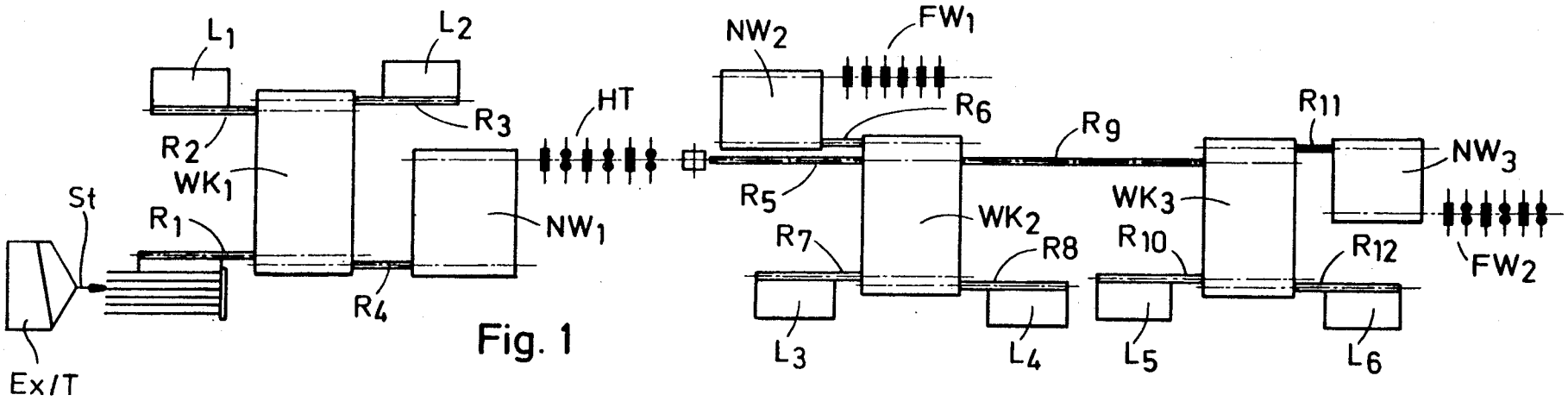
FIG. 1 is a top plan view of a plant using the process according to our invention.

A roller conveyor $R_1$ is associated with the lower supporting bar grate G' with the bar grate beams 1 and transports the semifinished product lengths HW in the direction of its longitudinal axis coming from the continuous casting direction St(compare with FIG. 1). They are pushed over the bar grate beams 1 in the direction of the arrow Pl by the push bars 6 and transported on the second roller conveyor $R_2$ which conveys the semifinished product lengths HW to the support.

Simultaneously semifinished product lengths HK are taken cold or still warm to the storage area and by the roller conveyor $R_3$ which is associated with the supporting beam 2 of the upper supporting bar grate G", transported and pushed on this supporting bar grate by the push bars 7 and further transported in the direction of the roller conveyor R4 which feeds the partially finished product HK to a processing unit e.g. a rolling line.

The hot semifinished product lengths HW on the lower supporting bar grate G' traveling in the direction of arrow P1, heat the traveling semifinished products HK running oppositely in the direction of the arrow P2 over the bar grate beams 1 before they are fed to the processing unit and/or a heating furnace. Both supporting bar grates G" and G' are enclosed by a thermally insulating chamber 9. The considerably larger spacing DG of the bar grate beam pairs of the upper supporting bar grate G" is such that it leads to an accessible passing of the contacting semifinished products.

Figure 5:
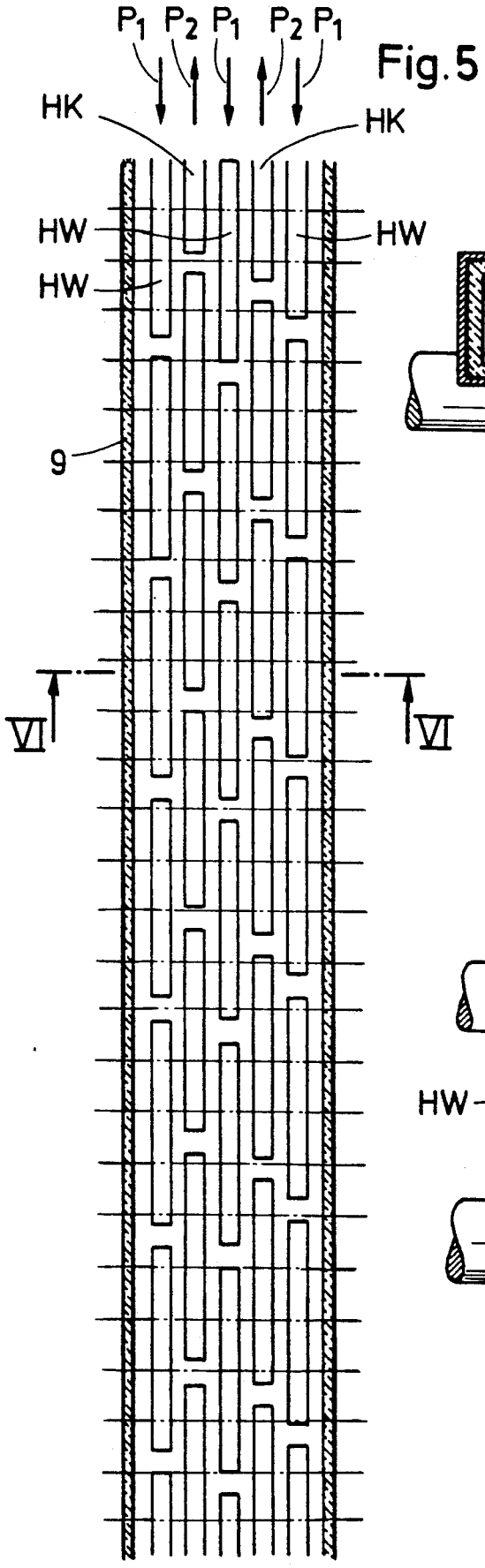
FIG. 5 is top cross sectional view through another embodiment of the heating unit.
Figure 6:
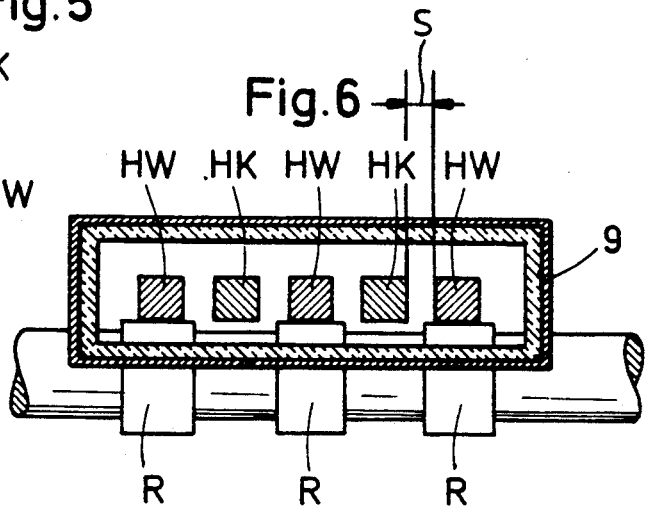
FIG. 6 is a cross sectional view through the heating unit of FIG. 5 taken along the line VI—VI thereof.

In the structure according to FIGS. 5 and 6 the heated semifinished products HW coming from the continuous casting or casting direction are carried by the rolls R of a roller conveyor and through a thermal insulating chamber 9 in the direction of the arrow P1(FIG. 5) while the semifinished products HK coming from the storage area supported by an automatically driven roller conveyor (not shown) are transported in the direction of the arrow P2 in the opposite direction to arrow P1 and are heated by heat transfer contact or proximity from both sides by the heated semifinished products HW. The semifinished products HW and HK have rectangular cross sections, then they are transported continuously and as seen from FIG. 7 held by guide rolls FR above the roller conveyor positioned with the rolls R.

Figure 7:
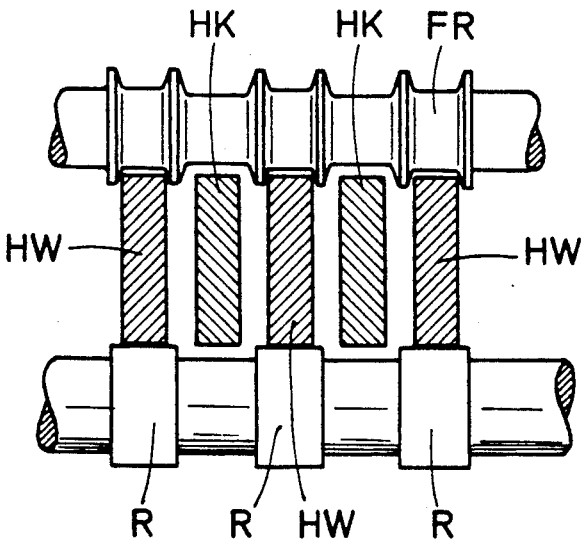
FIG. 7 is a cross sectional view through the heating unit of FIG. 5 taken transverse to the feed direction.

It is also possible to arrange two or more roller conveyors above each other, whereby the transport of the semifinished products can be effected in the way shown in FIGS. 5 to 7 so that the semifinished products HK can be transported running opposite each other to an upper roller conveyor and the semifinished products can be transported to another roller conveyor.

It is also possible to position two of the illustrated devices one behind the other in the transport direction, whereby after the semifinished products have left the first device can be turned to obtain a uniform heating.

Several units also can be positioned parallel beside each other to maintain a reduced transport length.

The heated semifinished products coming from the continuous casting direction are fed directly for further processing, to a finishing roll unit, and of course so that the described device operates in turn to compensate the differences between the delivery capacity of the continuous casting press direction and the receiving capacity for further processing.

Figure 8:
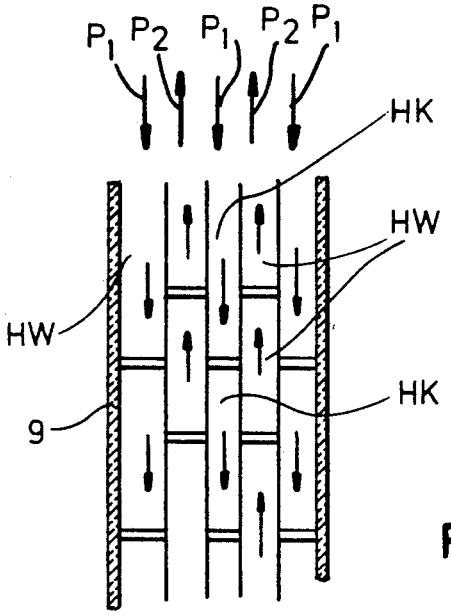
FIG. 8 is a cross sectional view of another embodiment of a heating unit similar to FIG. 5.
Figure 9:
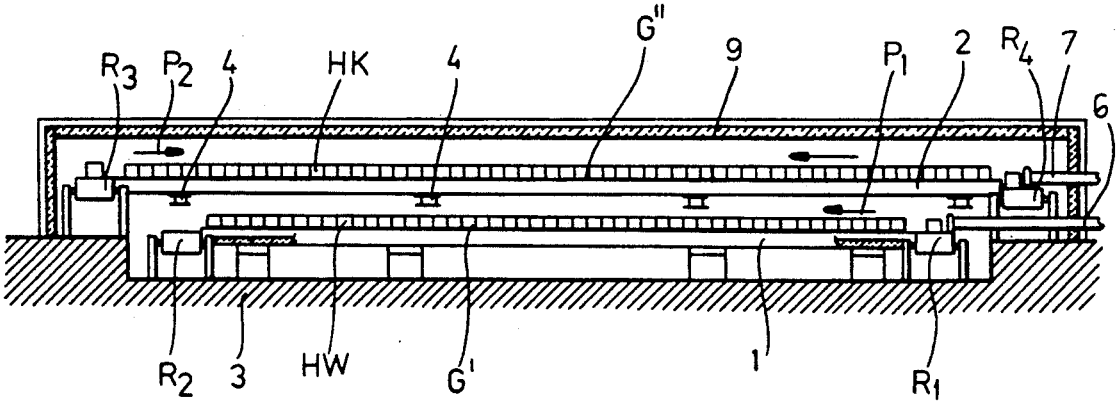
FIG. 9 is a cross sectional view of another embodiment of a heating unit similar to FIG. 3.

Advantageously as shown in FIG. 6 the spacing S between groups HW and HK is less than 3 mm. FIG. 8 shows a heating unit similar to FIG. 5 in which the semifinished product groups HK and HW are in direct contact with each other.

The semifinished products can be rotated about their longitudinal axes as indicated by the arrows R in FIG. 1 to provide a better heat transfer.

Auxiliary heating devices QTH, such as gas burners, as seen in FIG. 4 are provided in the embodiment of the thermally insulated chamber shown in FIGS. 3 and 4. Also an air pump AP circulating air in the thermally insulated chamber is also shown in these figures.

We claim:

1. In a process for the production of rolled products wherein:

a succession of relatively hot semifinished bodies forming a first group are produced by continuous casting;

the semifinished bodies of said first group are subjected to rough rolling to produce a second group of semifinished bodies; are the semifinished bodies of said second group are finish rolled to produce a third group of bodies, the bodies of each group having temperatures different from the bodies of the remaining groups, the improvement which comprises controlling the temperature of the bodies of one of said groups by the steps of:

moving the bodies of one of said groups along a transport path in a generally horizontal plane;

moving the bodies of another of said groups along a transport path in a generally horizontal plane and in spaced relationship from but in horizontal plane and in spaced bodies of said one of said groups as to effect heat transfer by radiation and convention between the bodies of said one of said groups and said other of said groups during the movement thereof; and regulating the temperature of the bodies of said one of said groups by controlling the heat transfer between the bodies of said one of groups and said other of said groups.

2. The improvement according to claim 1 wherein a colder one of said groups is positioned above a warmer one of said groups to effect said heat transfer during said movement.

3. The improvement according to claim 1 wherein said one and said other groups are displaced during said heat transfer in opposite directions.

4. The improvement according to claim 1 wherein said heat transfer is effected with movement of said one and said other groups in the same direction.

5. The improvement according to claim 1 wherein the directions of movement of said one and said other groups are transverse to each other.

6. The improvement according to claim 1, wherein the spacing between said one and said other groups is at most several mm.

7. The improvement according to claim 1 wherein said heat transfer is effected with a plurality of different speeds of movement of said one and said other groups.

8. The improvement according to claim 1 wherein said heat transfer is effected between said one and said other groups in a thermally insulated chamber.

9. The improvement defined in claim 8 wherein the group of bodies resulting from one of said rollings is fed to said thermally insulated chamber together with the group of bodies fed to said one of said rollings.

10. The improvement defined in claim 8 wherein the first group of bodies is fed to said thermally insulated chamber.

11. The improvement defined in claim 8 wherein the second group of bodies is fed to said thermally insulated chamber.

12. The improvement defined in claim 8 wherein the third group of bodies is fed to said thermally insulated chamber.

* * * * *